United States Patent [19]

Rouleau et al.

[11] Patent Number: 4,822,020

[45] **Date of Patent: * Apr. 18, 1989**

[54] ADVANCED APPARATUS FOR GRIPPING FLEXIBLE, AND IN PARTICULAR TEXTILE, LAYERS

[76] Inventors: Alain Rouleau, 3 Rue Espinasse; Patrick Rouleau, 52 Boulevard Carnot, both of 31000 Toulouse; Jean-Pierre Touret, Route de Menville, Bretx, 31530 Levignac, all of France

[ * ] Notice: The portion of the term of this patent subsequent to Jan. 13, 2004 has been disclaimed.

[21] Appl. No.: 17,479

[22] Filed: Feb. 24, 1987

[30] Foreign Application Priority Data

Feb. 24, 1986 [FR] France ..... 86 02951

[51] Int. Cl.[4] ..... B65H 3/22

[52] U.S. Cl. ..... 271/18.3; 271/19; 294/61

[58] Field of Search ..... 271/18.3, 18, 19, 42, 271/168, 161; 294/104, 103.1, 61; 414/120, 128; 901/39; 221/213, 210

[56] References Cited

U.S. PATENT DOCUMENTS

| | | | |
|---|---|---|---|
| 3,902,750 | 9/1975 | Roitel | 294/104 X |
| 4,437,655 | 3/1984 | Bijttebier et al. | 271/18.3 X |
| 4,601,463 | 7/1986 | Goto et al. | 271/18.3 X |
| 4,635,918 | 1/1987 | Rouleau et al. | 271/18.3 |

*Primary Examiner*—Joseph J. Rolla
*Assistant Examiner*—David H. Bollinger
*Attorney, Agent, or Firm*—Harold H. Dutton, Jr.

[57] ABSTRACT

The present invention relates to an apparatus for gripping layers of flexible material, comprising a head (14) provided with a contact surface, a clearance (16) in the said surface, a needle (103) mobile with respect to the head, a thin groove (15) in the head and kinematic guide means for the needle in the plane of the groove (15). According to the present invention the contact surface is provided with a step (102) and has a recessed area (100) and a protruding area (101). Two contact pins (110, 111) are in a preferred embodiment located either side of the groove (15) level with the recessed area. These measures improve the superficial catching conditions of the upper layer of the flexible material to be seized and avoid the risk of seizing the layer below.

12 Claims, 3 Drawing Sheets

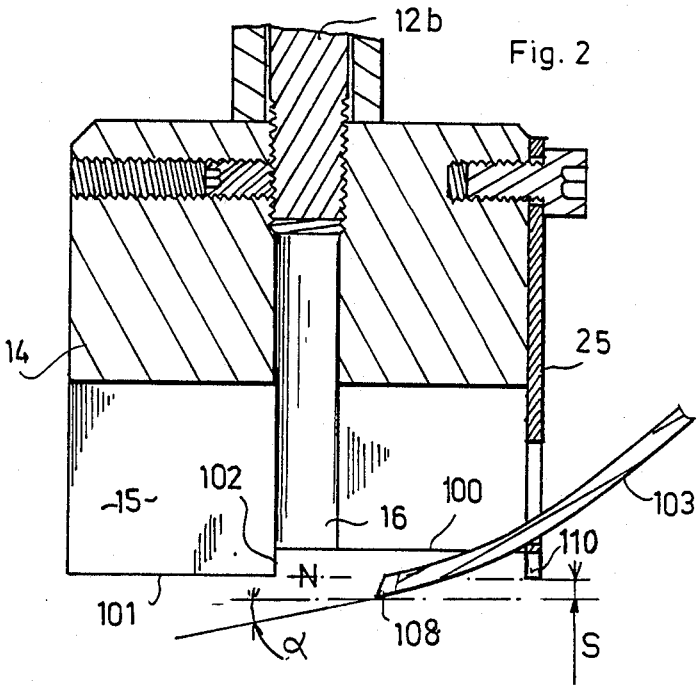
Fig. 2
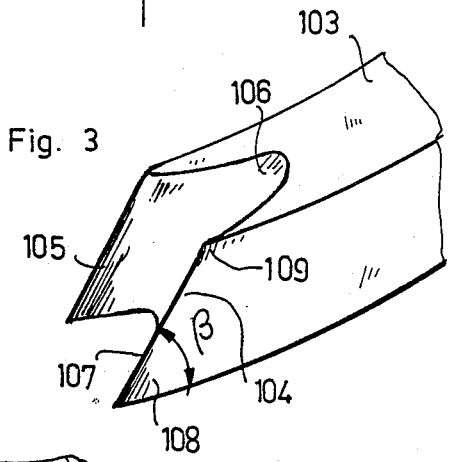
Fig. 3
Fig. 4
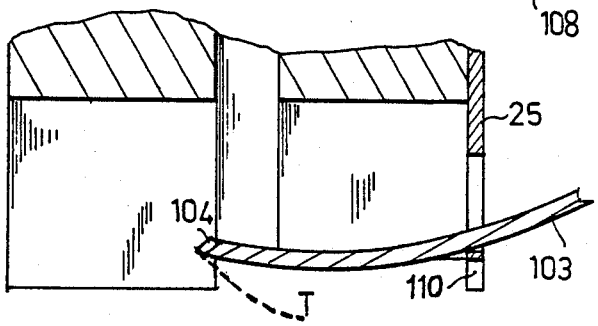

ADVANCED APPARATUS FOR GRIPPING FLEXIBLE, AND IN PARTICULAR TEXTILE, LAYERS

The present invention relates to an advanced apparatus for gripping textile layers, knitted, woven or others. It relates to an apparatus of a type described by French Pat. No. 84.04804 or the corresponding U.S. Pat. No. 4,635,918, filed by the applicants which U.S. Pat. is incorporated herein by reference.

These patents describe a gripping apparatus which enables the upper layer of a pile to be seized without all the others, so as to detach it from the lower layers with a view to transferring it. This apparatus enables both a firm seizure of the said upper layer to be assured in order to avoid that the latter is dropped during transfer and also to guarantee the disengagement of this layer when it is deposited at the end of transfer.

To this end, the apparatus in question comprises a contact surface and a needle mobile with respect to the former: this needle operates in conjunction with a clearance and a thin groove provided for in the contact surface in order to perform first a corrugation of the layer to be seized and then push this corrugation towards the clearance and grip or stitch the latter at the end of the motion.

The present invention is intended to improve the apparatus in order to reduce still further the risks of gripping several layers, even in the case of extremely thin layers (a few tenths of a millimeter).

It should be noted that this reliability in seizing a single layer is in practice essential in order to enable the apparatus to be incorporated into an automated process.

The apparatus subject of the present invention comprises the following basic parts:

- at least one head provided with a contact surface,
- a clearance provided in the said contact surface,
- a needle associated with the head and mobile in relation to the latter from an initial position where the tip of the needle is located on one side of the clearance,
- a thin groove made in the head in such a way as to have a thickness greater than that of the needle in order to be able to contain it, the said groove crossing the clearance,
- and needle-to-head kinematic guides able to guide the tip of the needle on a path located in the plane of the groove and directed at least in its final portion towards the contact surface.

According to the present invention, the contact surface is provided with a recess and has on the side of the needle an area called the recessed area located slightly recessed at the inverse of the area called the protruding area, in order to assure different pressures on the layer of flexible material at the two areas.

So, the material undergoes a smaller pressure in its part due to form a corrugation and so freed in this portion, lends itself better to the creation of a corrugation. The latter is formed more surely, the needle's necessary friction force becoming very slight.

Moreover, according to another characteristic of the present invention the contact surface is provided in its recessed area with at least two contacts pins located either side of the aforementioned groove. In a preferred embodiment each pin protrudes in relation to the recessed area on a thickness substantially equal to the depth of the aforementioned step.

These pins improve the holding and guiding of the flexible layers while maintaining the freedom of movement or deformation of the upper layer at the recessed area. Experiments have shown that these pins further reduced the risk of seizing the lower layer by assuring an additional constraining of the latter preventing this lower surface from folding. In particular, such an apparatus is extremely efficient in the case of non-homogeneous stacking where layers adhere to each other in pairs; in this case the lower layer of a pair has a strong tendency to follow the movement of the layer above: despite this tendency, the apparatus of the present invention is able to seize only the latter.

According to a preferred embodiment especially in the case of very thin layers, the needle is shaped so as to be provided with two separate tips and a stop means (formed by the part located between the bases of the said tips). These tips are preferably bevel-edged so as to form in the part coming into contact with the material an acute angle suitable for catching the material superficially in order to form a corrugation by pushing the material towards the clearance in the contact surface.

Furthermore, according to another characteristic of the invention, the needle is a curved needle with its concave side pointed towards the contact surface and its kinematic guides are designed to impose to the said needle an initial position such that its tip protrudes from the recessed area of the contact surface and above the tangent to the said tip creates a slight angle with respect to the plane of the said area.

As it will appear more clearly below, this characteristic combines with the outer characteristics of the invention (freeing of the material at the recessed area; needle with stop means, etc . . . ) in order to guarantee the formation of a corrugation in the upper layer of the material by means of a superficial catching of the said layer removing any risk of simultaneously catching the lower layer. Thus on one hand, the guarantee of creating a corrugation in the upper layer results in the certainty of seizing this layer at the end of the movement of the needle, and on the other, the manner in which this corrugation is formed by superficial catching ensures that only this upper layer is seized.

According to another characteristic of the present invention, the kinematic needle guides are located in order to enable the needle to travel towards the contact surface: elastic means are then combined with the said needle in order to draw it in the direction of its movement away form the head towards an extreme stop position. In its initial stop position the tip of the needle protrudes slightly with respect to the level of the protruding area of the contact surface, so that the said tip is initially repelled by the upper layer of the flexible material and rests elastically against the latter. This measure further improves the superficial catching conditions of the upper layer and enables an apparatus of remarkable reliability to be obtained: certain seizure of the upper layer, absolute removal of any risk of seizing the lower layer.

Other characteristics, purposes and advantages of the present invention will appear in the description which follows with reference to the appended drawings, which present as a non-exhaustive example a preferential mode of embodiment; in these drawings which form an integral part of the present description:

FIG. 2 is a partial cross-section by a vertical axial plan showing the needle in its initial position, FIG. 3 is a detailed perspective view of the tip of the needle, FIG. 4 is a partial cross-section of the apparatus showing the needle at the end of its movement.

Figure 1:
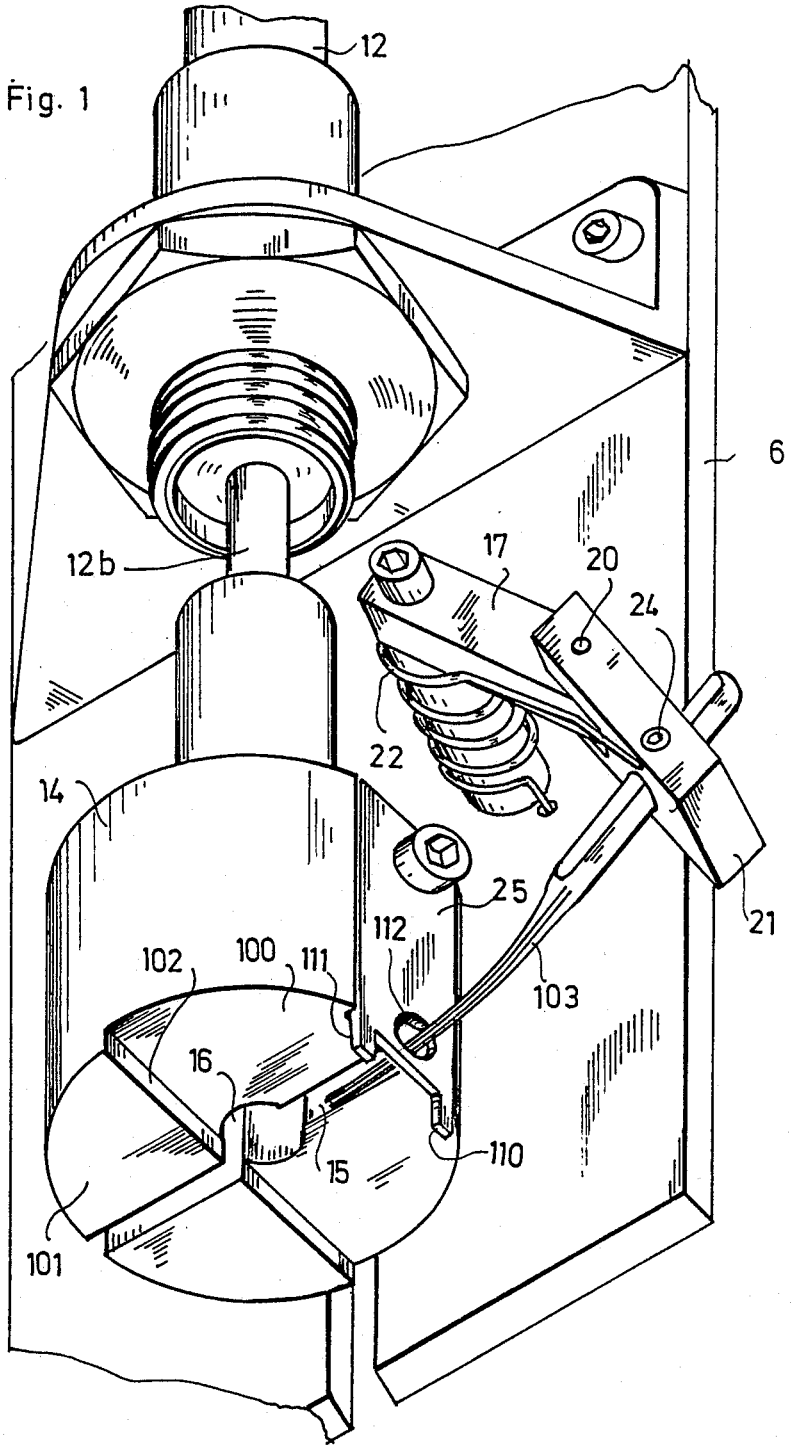
FIG. 1 is a partial perspective view of this embodiment at an expanded scale.

The gripping apparatus shown as an example in the figures comprises a gripping assembly mounted on a vertical plate (6) borne by a framework provided with air blowing means (not shown); this framework, these blowing means and the attachement of the plate to the framework are similar to those described in French Pat. No. 84.04804 or U.S. Pat. No. 4,635,918 already mentioned and will not be described again.

The plate (6) bears the body of a double acting pneumatic jack (12) whose mobile rod (12*b*) is directed downwards in a substantially vertical position. As in the main application, this jack (12) is combined with a proximity sensor (not shown).

At the lower part, a gripping head (14) is screwed onto the end of the rod (12*b*) of the jack so as to be able to move according to a vertical translating motion (as in the U.S. Pat. No. 4,635,918, the guide means prevent the head rotating about itself and guide it in translation).

This head is formed of a cylindrical section whose lower base is designed to act as a contact surface for the material to be seized. This base comprises a step of a few tenths of a millimeter to a few millimeters and consists of two plane areas, one (100) recessed with respect to the other (101). In the example, these two areas are separated by a straight shoulder (102) whose depth may in particular be between 0.2 and 1 mm according to the thickness of the layers to be seized. A thickness of 0.4 mm suits very thin layers of a few tenths of a millimeter perfectly.

The head (14) is split by a thin lined groove (15) slightly thicker than the needle described below. The groove runs in a vertical plan substantially perpendicular to areas 100 and 101 and emerges along a diameter perpendicular to shoulder (102).

Moreover, head (14) is provided with a clearance (16), of circular cross-section in the example which emerges at the recessed areas (100), at the center of the head. This clearance (16) stretches either side of the plane containing the groove (15) which crosses it diametrically. Shoulder (102) passes near the said clearance, the protruding area (101) stretching from one side of the latter, the recessed area stretching to the other; in the example the shoulder (102) is approximately tangential to the clearance (16).

Moreover, the contact surface is provided in its recessed area (100) with two contact pins (110) and (111), located either side of the groove (15) at the edge of the said recessed area. In the example these pins are borne by a guide plate (25) attached on the edge of the head. These contact pins located on either side of the base of the plate (25) are dimensioned so as to protrude to the level N of the protruding area (101).

Furthermore, plate (6) bears the kinematic guides of a needle (103). These guides consist of elements similar to those described in the U.S. Pat. No. 4,635,918: support (17) mounted on plate (6) transversally with relation to the head, hinge spindle (20) born by support (17) around which a link (21) may pivot, elastic means (22) driving the link (and so the needle) in its direction away from the head, pressure screw (24) attaching the needle (103) by its heel.

These means are layed out so that the needle is positioned in the plane of the groove (15) and may move in this plane with respect to the head, by rotation of the link around its spindle (20).

Needle (103) is a curved needle whose concave side is oriented towards the contact surface of the head. It passes through an aperture (112) provided in the guide plate mentioned above, which is attached at the edge of the head. This aperture has a dimension much greater than the needle to allow the latter to move to the contact surface, the elastic means (22) tending to press a needle against the lower edge of the set aperture (which defines the extreme stop position).

As shown in FIGS. 1, 2 and 3, the needle is shaped in order to have at its end two separated tips (104 and 105) and a stop means (106); the latter is formed by the part located between the basis of the said tips. These tips may protrude approximately 3/10th to 6/10th of a millimeter with respect to the stop means.

Each tip has a forward bevelled-edge such as (107), oriented so that the angular part (108) of the said edge (the part located at the inverse side of the contact surface designed to come into contact first of all with the material) forms an acute angle $\beta$, particularly of between 60 to 80 degrees, and protrudes forward with respect to the other angular part (109) (located at the inverse of the contact surface).

Morevover, the kinematic guides (plate aperture (25), link (21), support (17) are mounted in order to impose to the needle an initial position such as that illustrated in FIG. 2. The end of the latter protrudes with respect to the recessed area (100), but also with respect to level N of area (101); in this initial position, the tip of the needle is located in the vicinity of the clearance (16). The protrusion —S— of the needle with respect to level N may be a few tenths of a millimeter.

Moreover, in itis initial position when the needle is not repelled, the tangent at its tip forms a slight angle $\alpha$ with respect to a plane parallel to the contact surface. This angle may be of approximately a few degrees (up to 20° to 30°). So, the needle comes into contact with the upper layer of the material almost tangentially when the contact surface is placed against a stack of layers.

Furthermore, the needle is guided so that during its movement, it passes through the clearance in order to reach at its end of travel a final position as shown in FIG. 4. The path T of the tip of the needle has been represented in this figure assuming that the latter was not repelled by a layer of material.

In the final portion of the path T, the two tips (104 and 105) enter groove (15) (the half of the groove at the inverse of the half in which the needle arrives). In this position the stop means (106) which is located at the base of the tips is approximately at the intersection between the groove and the clearance.

At the end of travel, the needle is thus able to catch the corrugation of material which has been formed in the first part of the movement.

Figure 5A:
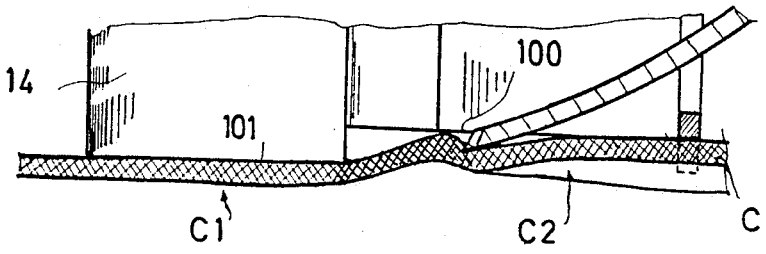
FIGS. 5*a*, 5*b*, 5*c* and 6 are explanatory diagrams of the operation of the apparatus.
Figure 5B:
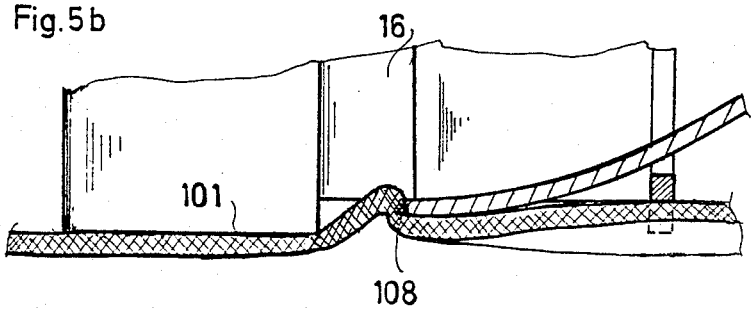
Figure 5C:
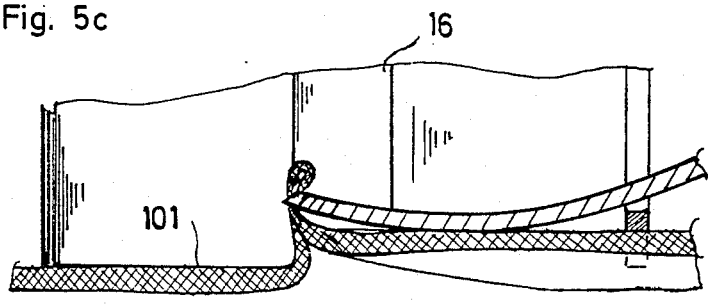

FIGS. 5*a*, 5*b* and 5*c* illustrate the operation of the apparatus.

Figure 6:
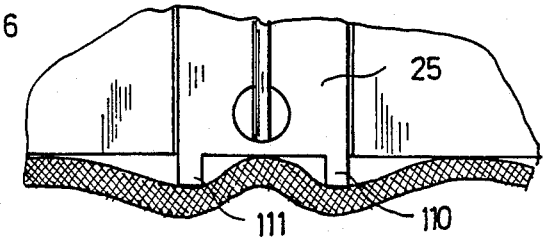

In the first phase (FIG. 5*a*) the head (14) is in the lower position and the jack (12) which bears it is exposed. The stacking whose upper layer is symbolized by C enters into contact with the contact surface. Part C1 of the upper layer which is located in contact with the protruding area (101), is clamped by the latter, while part C2 located at the inverse of the recessed area (100) keeps a certain freedom. Pins 110 and 111 form an additional rest which, without removing this freedom, ensure the stacking is held so avoiding the lower layer from following the distorsions of movements of the upper layer and this even if considerable adhesion links the two layers. A detail of the head seen from the side of the plate (25) is shown in FIG. 6.

The needle (103) rests against part C2 of the upper layer and is slightly repelled by the latter: an elastic support with a slight angle of penetration is thus formed.

The relative moving together of the stacking and the head (FIG. 5*b*) causes the head to be retracted upwards and a movement of the needle towards the head and towards the clearance (16) in the latter: the angular parts (108) on the tip of the needle catch the upper layer of the material. The stop means (106) located between the tips limit the latter's penetration. The elasticity of the support (provided by the elastic means (22)) contributes to ensuring a superficial catching. The upper layer clamped by area (101), is corrugated as shown in FIG. 5*b*, forming an inverted V-shaped corrugation which is housed in the clearance (16).

At the end of the head/stack moving together, the needle reaches a position illustrated in FIG. 5*c*. It catches the corrugation of the material at the intersection between the groove and the clearance. Only the short tips located protruding from the stop means enter the material.

In this position, the proximity sensor commands the pneumatic supply of the jack (12) which locks the head in the up position. The firmly held layer of material is thus locked and cannot be dropped.

The stack is then separated from the head and the transfer then depositing operations of the layer seized may be performed.

We claim:

1. An apparatus for gripping flexible material comprising at least one head (14) having a contact surface, a clearance (16) in said contact surface, a needle (103) associated with said head and movable with respect to said head from an initial position in which the tip of the needle is located on one side of the clearance to a final position, a thin groove (15) provided in said head and having a thickness greater than the thickness of said needle and crossing said clearance in the head, kinematic guides for the needle (103) with respect to the head (14), for guiding the tip of the needle along a path lying in said groove (15) and directed at least in said final position toward the contact surface, said contact surface including a step (102) for dividing said contact surface into a recessed area (100) slightly recessed with respect to an opposite protruding area (101) for ensuring different pressures on the layer of flexible material at the two areas, said kinematic guides comprising a hinge link (21) for bearing said needle (103), a hinge spindle (20) for said link and carried by a support (17), translation guiding means (12) for allowing a relative translational movement between said support (17) and said head (14), and a guide plate (25) connected to said head (14) and provided with an aperture (112) penetrated by said needle (103).

2. Gripping apparatus according to claim 1 and wherein the contact surface is provided with at least two contact pins located either side of the groove (15) in its recessed area (100).

3. Gripping apparatus according to claim 2 and wherein the clearance (16) is adjacent said step (102) in the contact surface so that the recessed area (100) and the protruding area (101) extend on opposite sides of said clearance.

4. Gripping apparatus according to claim 3 and wherein the step (102) in the contact surface extends substantially along a straight line perpendicular to the groove (15).

5. Gripping apparatus according to claim 4 wherein the clearance (16) is substantially located in the middle of the contact surface, the groove (15) being designed so as to cross diametrically the said clearance, the said apparatus being characterized by the fact that the step between the recessed area (100) and the protruding area (101) of the contact surface forms a shoulder perpendicular to the groove (15) and approximately tangential to the clarance (16) which emerges in the recessed area (100).

6. Gripping apparatus according to claim 1 and wherein the recessed area (100) and the protruding area (101) are planar, the step (102) between these areas having a depth of approximately 0.2 to 1 mm.

7. Gripping apparatus according to claim 2 and wherein each contact pin protrudes with respect to the recessed area over a thickness substantially equal to the depth of the step (102).

8. Gripping apparatus according to claim 1 and wherein the needle (103) is shaped so as to have at its end two separate tips (104 and 105) and a stop means (106) located between said tips.

9. Gripping apparatus according to claim 8 and wherein each needle tip (104, 105) has a forward beveled edge of an acute angle ($\beta$) and protrudes forward.

10. Gripping apparatus according to claim 9, and wherein the kinematic guides are designed so that the needle (103) passes through the clearance (16), and its two tips (104, 105) enter the groove (15) so that the stop means (106) is located approximately at the intersection between the said groove and the said clearance.

11. Gripping apparatus according to claim 1, and wherein the needle (103) is a curved needle having a concave side oriented towards the contact surface and a tip, and characterized by the fact that the kinematic guides are designed to impart to the needle an initial position such that the tip of the latter protrudes with respect to the recessed area (100) of the contact surface, near the clearance (16) and that the tangent at the said tip forms a slight angle ($\alpha$) with respect to a plane parallel to the contact surface.

12. Gripping apparatus according to claim 11, and wherein the kinematic guides are designed to let the needle (103) have a freedom of movement towards the contact surface, elastic means (22) being associated with the said needle to drive the latter in its movement away from the head (14) towards an extreme stop position, characterized by the fact that in its initial stop position, the tip of the needle (103) protrudes slightly with respect to the level of the protruding zone (101) of the contact surface, so as that the said tip is initially repelled by the upper layer of the flexible material and comes to rest elastically against the latter.

* * * * *